US006229081B1

(12) United States Patent
Ura et al.

(10) Patent No.: US 6,229,081 B1
(45) Date of Patent: May 8, 2001

(54) KEYBOARD MUSICAL INSTRUMENT, POSITION SENSING DEVICE AND LIGHT-EMITTING CONTROLLER BOTH INCORPORATED THEREIN

(75) Inventors: Tomoyuki Ura; Tsutomu Sasaki, both of Shizuoka (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/396,097

(22) Filed: Sep. 14, 1999

(30) Foreign Application Priority Data

| | | |
|---|---|---|
| Sep. 18, 1998 | (JP) | 10-265532 |
| Sep. 18, 1998 | (JP) | 10-265535 |
| Mar. 5, 1999 | (JP) | 11-059443 |
| Mar. 5, 1999 | (JP) | 11-059445 |

(51) Int. Cl.[7] ..... G10G 3/04
(52) U.S. Cl. ..... 84/462; 84/19; 84/724
(58) Field of Search ..... 84/19–21, 462, 84/724

(56) References Cited

U.S. PATENT DOCUMENTS

| | | | | |
|---|---|---|---|---|
| 4,899,631 | | 2/1990 | Baker . | |
| 5,291,011 | * | 3/1994 | Mantani | 84/462 X |
| 5,524,521 | * | 6/1996 | Clift et al. | 84/462 |
| 5,567,902 | | 10/1996 | Kimble et al. . | |
| 5,619,005 | | 4/1997 | Shibukawa et al. . | |
| 5,629,490 | * | 5/1997 | Inaba | 84/20 X |
| 5,731,530 | * | 3/1998 | Fujiwara et al. | 84/21 |
| 5,824,930 | | 10/1998 | Ura et al. . | |

FOREIGN PATENT DOCUMENTS

| | | |
|---|---|---|
| 0 696 790 | 2/1996 | (EP) . |
| WO96/30891 | 10/1996 | (WO) . |

* cited by examiner

*Primary Examiner*—Jeffrey Donels
(74) *Attorney, Agent, or Firm*—Morrison & Foerster

(57) ABSTRACT

An automatic player piano is equipped with a position detecting device for detecting current positions of the black/white keys, and the position detecting device radiates light beams across the trajectories of the black/white keys, wherein the position detecting device stores a variable relation between a relative value of the amount of light and the current positions for determining the current positions so that the position detecting device keeps the reliability of the current positions against aged deterioration.

15 Claims, 6 Drawing Sheets

KEYBOARD MUSICAL INSTRUMENT, POSITION SENSING DEVICE AND LIGHT-EMITTING CONTROLLER BOTH INCORPORATED THEREIN

FIELD OF THE INVENTION

This invention relates to a musical instrument and, more particularly, to a keyboard musical instrument of the type having key sensors for detecting the current positions of keys, a position sensing device and a light-emitting controller both incorporated therein.

DESCRIPTION OF THE RELATED ART

An automatic player piano is an example of the keyboard musical instrument. The automatic player piano records a performance on the keyboard, and stores the performance in a suitable memory in the form of pieces of music data information. When a user requests the automatic player piano to reproduce the performance, the pieces of music data information are read out from the memory, and selectively energizes key actuators so as to move the black/white keys without fingering. Thus, the automatic player piano has two modes of operation, i.e., the recording mode and the playback mode.

Key sensors are provided under the black/white keys, and convert the current key positions to positional signals. The positional signals are supplied to a controller, and the controller extracts the pieces of music data information to be required for the playback from the positional signals and variance thereof. Thus, the key sensors are important components of the automatic player piano.

An optical key sensor is popular to the automatic player piano. A light-emitting diode is paired with a photo-detecting diode, and produces a light beam across a trajectory of a shutter plate attached to the black/white key. If the optical key sensors are individually installed for the black/white keys, the installation makes the price of the automatic player piano go up.

An optical sensor matrix was proposed in Japanese Patent Application No. 7-270332, which was published, as Japanese Patent Publication of Unexamined Application No. 9-54584. Twelve light emitting diodes and eight photo diodes form in combination the optical sensor matrix for the keyboards, which usually consists of eighty-eight black/white keys.

FIG. 1 illustrates the optical sensor matrix. Although the optical sensor matrix is used for eighty-eight black/white keys, only one white key 10 is shown in FIG. 1. A shutter plate KS is attached to the lower surface of the white key 10, and is hatched in FIG. 1 for the purpose of discrimination. The prior art optical sensor matrix includes a light emitting sensor head 221, a light receiving sensor head 222, a light emitting diode array 224, a photo diode array 225 and bundles of optical fibers 226 and 227. The light emitting sensor head 221 and the light receiving sensor head 222 are fixed to a frame SB together with other light emitting sensor heads (not shown) and other photo detecting sensor heads 222 (not shown), and are spaced from one another. Twelve light emitting diodes form the array 224, and eight photo-detecting diodes form the other array 225. One of the light emitting diodes is connected through an optical fiber of the bundle 226 to the light emitting sensor head 221, and the light receiving sensor head 222 is connected through an optical fiber of the bundle 227 to one of the photo detecting diodes. Each of the light emitting diodes 224 is connected to eight optical fibers of the bundle 226, and twelve optical fibers of the bundle 227 are connected to each photo detecting diode 225. For this reason, eight light emitting sensor heads 221 concurrently radiate the eight optical beams, and the eight photo diodes 225 simultaneously receive the light transferred from the associated light receiving sensor heads 222 through the optical fibers 227. Although the combinations of the light emitting diodes 224 and the photo detecting diodes 225 are ninety-six, only eighty-eight combinations are used for the eighty-eight black/white keys.

When the light emitting diode 224 is energized, the light emitting diode generates light. The light is propagated through the optical fiber 226 to the light emitting sensor head 221, and the light emitting sensor head 221 radiates a light beam to the light receiving sensor head 222 across the trajectory of the shutter plate KS. The light beam is 5 millimeter in diameter. The light receiving sensor head 222 receives the light beam, and the received light is propagated through the optical fiber 227 to the associated photo diode 225. The photo diode 225 converts the light to an electric signal Sa, and supplies the electric signal Sa to a controller (not shown).

The electric signal Sa is representative of the amount of received light. A player is assumed to depress the white key 10. The white key 10 sinks toward the end position, and the shutter plate KS gradually intersects the light beam. As a result, the amount of received light is decreased, and, accordingly, the photo detecting diode 225 reduces the magnitude or the voltage of the electric signal Sa.

The position-to-voltage converting characteristics of the prior art optical sensor matrix is represented by plots C1 in FIG. 2. The rest position of the white key 10 and the end position of the white key 10 are respectively abbreviated as "$K_R$" and "$K_E$" in FIG. 2. The shutter plate $K_S$ partially intersects the optical beam at the rest position $K_R$, and the shutter plate $K_S$ is evacuated from the optical beam at position "$K_O$". The potential level of the electric signal Sa gradually falls from the rest position $K_R$ to the end position $K_E$. When the white key 10 reaches the end position $K_E$, the shutter plate KS allows part of the light beam to reach the light receiving sensor head 222, and the electric signal Sa still has a potential level. If the shutter plate KS reaches the position $K_D$, the shutter plate KS perfectly intersects the light beam, and the photo detecting diode 225 decreases the potential level of the electric signal Sa to zero. The white key 10 is moved between the rest position $K_R$ and the end position $K_E$, and the photo detecting diode 225 varies the electric signal along the plots between the rest position $K_R$ and the end position $K_E$.

The position-to-voltage converting characteristics C1 is determined for a typical key during the fabrication of the automatic player piano, and pieces of control data information representative of the position-to-voltage converting characteristics C1 are stored in a non-volatile memory. The controller (not shown) determines the current key position on the basis of the position-to-voltage converting characteristics C1 during the recording, and digital codes representative of the pieces of music data information are produced from the current key position and the variance of the current key position. However, the performance reproduced in the playback is not consistent with the original performance. This is the problem inherent in the prior art automatic player piano.

SUMMARY OF THE INVENTION

It is therefore an important object of the present invention to provide an automatic player piano, which faithfully reproduces an original performance. It is also an important object of the present invention to provide a position sensing device, which exactly determines the current position of a moving object such as, for example, a black/white key.

The present inventors contemplated the problem inherent in the prior art automatic player piano, and noticed that the light emitting diodes 224, the optical fibers 226/227 and the photo diodes 225 had individualities. The individualities were influential on the position-to-voltage converting characteristics. Each of the prior art optical key sensors was the combination of the light emitting diode 224, the optical fibers 226/227, the light emitting sensor head 221, the light receiving sensor head 222 and the photo detecting diode 225, and the position-to-voltage converting characteristics of one optical key sensor were usually different from the position-to-voltage converting characteristics of the others. Moreover, the position-to-voltage converting characteristics were varied with time as indicated by plots C2 in FIG. 2. In this situation, if the controller determined the current key position on the basis of the position-to-voltage converting characteristics C1, the current key position unavoidably contained error, and the pieces of music data information did not exactly represent the original performance.

Firstly, the present inventors tried to rewrite the pieces of control data information from the position-to-voltage converting characteristics C1 to the position-to-voltage converting characteristics C2. However, the rewriting work was complicated, and only a few user could respond. The present inventors concluded that the approach was not feasible.

Second, the present inventors tried to map the position-to-voltage converting characteristics C1 to the position-to-voltage converting characteristics C2, because the variance of voltage from $L_{R1}$ to $L_{R1}'=L_{R2}$ and from $L_{E1}$ to $L_{E1}'=L_{E2}$ were easily measured. However, the profile between $L_{R1}'$ and $L_{E1}'$ was different from the profile between $L_{R2}$ and $L_{E2}$. Even though the position-to-voltage converting characteristics C1 were exactly mapped, the mapped characteristics did not give the exact current positions to the controller.

The present inventors noticed that the position-to-voltage converting characteristics C2 had the profile analogous to that of the position-to-voltage converting characteristics C1. This meant that the position-to-voltage converting characteristics C2 were predictable. Otherwise, the electric power at the light emitting diodes 224 was made variable. If the position-to-voltage converting characteristics were varied from C1 to C2, increased electric power pushed up the position-to-voltage converting characteristics from C2 to C1.

In accordance with one aspect of the present invention, there is provided a musical instrument comprising plural manipulators movable within respective monitored ranges, and selectively manipulated by a player for specifying an attribute of sound and a position sensing device including plural sensors respectively provided for the plural manipulators and respectively creating the monitored ranges, a physical quantity in each of the monitored ranges being varied depending upon a current position of associated one of the manipulators and a controller storing a relation between the amount of the physical quantity and the current positions of the manipulators and determining the current position of each manipulated manipulator on the basis of the amount of physical quantity supplied from associated one of the plural sensors for determining the attribute of sound.

In accordance with another aspect of the present invention, there is provided a position sensing device comprising plural sensors respectively provided for plural manipulators and respectively creating monitored ranges where the plural manipulators are moved, a physical quantity in each of the monitored ranges being varied depending upon a current position of associated one of the manipulators and a controller storing a relation between the amount of the physical quantity and the current positions of the manipulators and determining the current position of each manipulated manipulator on the basis of the amount of physical quantity supplied from associated one of the plural sensors.

In accordance with yet another aspect of the present invention, there is provided a light-emitting controller for plural light-emitting elements, comprising a current-controlling circuit connected between a first source of power voltage and a power distribution line connected in parallel to the plural light-emitting elements and responsive to a first control signal for varying a resistance between the first source of power voltage and the power distribution line, a selector connected between the plural light-emitting elements and a second source of power voltage different in voltage level from the first source of power voltage, and responsive to a second control signal for sequentially connecting the plural light-emitting elements to the second source of power voltage and a signal generator supplying the first control signal and the second control signal to the current-controlling circuit and the selector so as to change the resistance optimum to selected one of the plural light-emitting elements.

BRIEF DESCRIPTION OF THE DRAWINGS

The features and advantages of the keyboard musical instrument and the position sensing device will be more clearly understood from the following description taken in conjunction with the accompanying drawings in which.

DESCRIPTION OF THE PREFERRED EMBODIMENT

Figure 3:
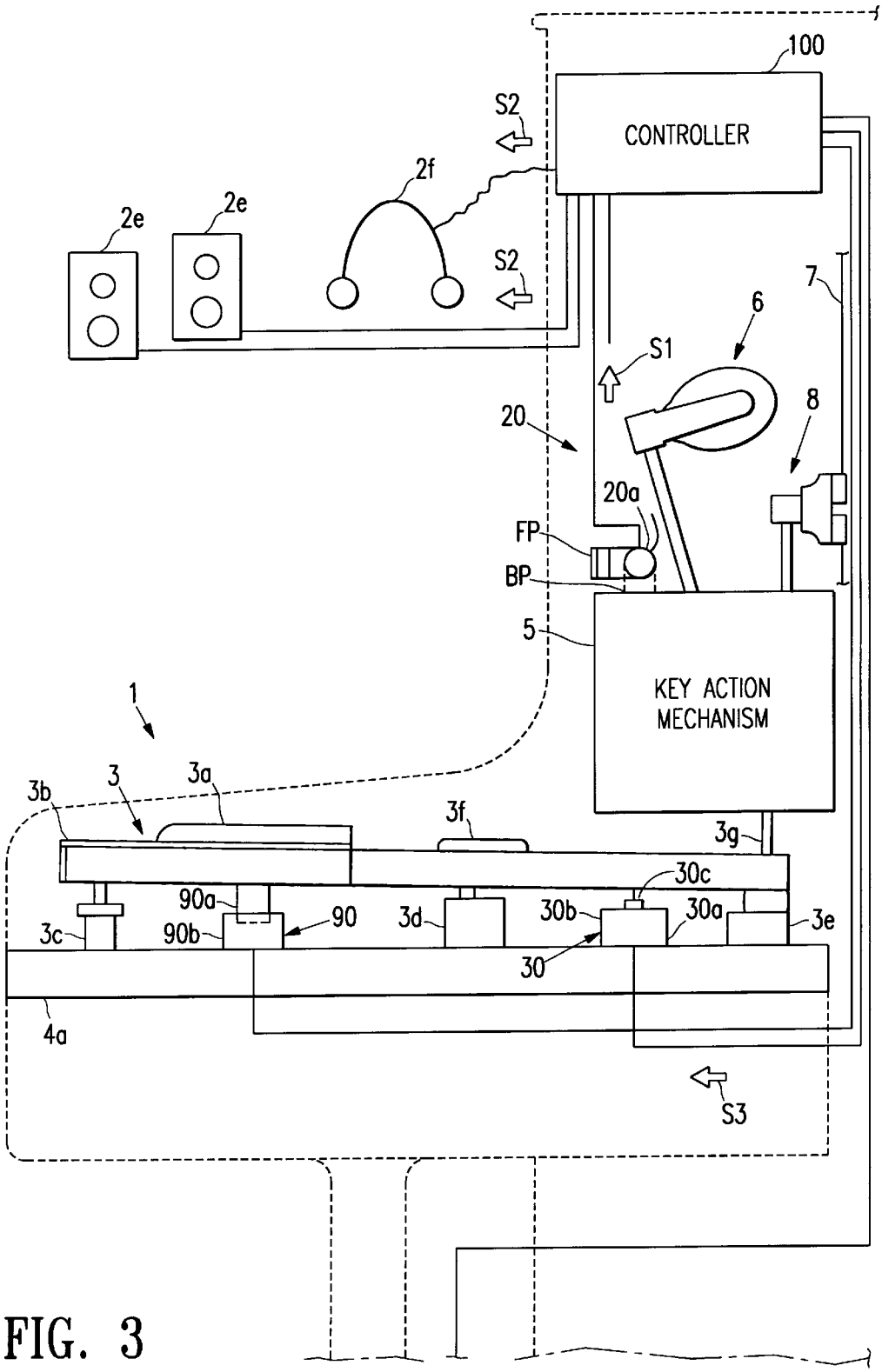
FIG. 3 is a schematic view showing the structure of an automatic player piano according to the present invention.

Referring to FIG. 3 of the drawings, an automatic player piano embodying the present invention largely comprises an acoustic upright piano 1, a silent system 20 and an automatic playing system 30. A player fingers a piece of music on the acoustic upright piano 1, and the acoustic upright piano 1 generates acoustic sounds for the piece of music. The silent system 20 permits the player to finger the piece of music without the acoustic sounds, and generates electronic sounds in response to the fingering. The automatic playing system 30 records the performance, and reproduces the performance without the fingering of the player. In the following description, word "front" is indicative of a relative position closer to a player than a "rear" position, and the direction between the front position and the rear position is modified by using word "longitudinal". The lateral direction is perpendicular to the longitudinal direction.

Acoustic Upright Piano

The acoustic upright piano 1 includes a keyboard 3. The keyboard 3 is placed on the key bed 4*a,* and includes black keys 3*a* and white keys 3*b,* a front rail 3*c,* a balance rail 3*d* and a back rail 3*e.* The front rail 3*c,* the balance rail 3*d* and the back rail 3*e* laterally extend in parallel on the key bed 4*a,* and are spaced from one another in the longitudinal direction. The black keys 3*a* and the white keys 3*b* are laid out on the well-known pattern, and are independently turnable around the balance rail 3*d.* Notes of a scale are assigned to the black/white keys 3*a*/3*b.* Balance pins 3*f* keep the black keys 3*a* and the white keys 3*b* at the right positions. In this instance, eighty-eight black/white keys 3*a*/3*b* are incorporated in the keyboard 3.

While any force is not exerted on the black keys 3*a* and the white keys 3*b,* the black keys 3*a* and the white keys 3*b* sink their rear ends on the back rail cloth adhered to the back rail 3*e,* and are staying in the rest positions, respectively. When a player depresses the black/white keys 3*a*/3*b,* the black/white keys 3*a*/3*b* are driven for rotation in the counter clockwise direction, and reach end positions, respectively. Capstan screws 3*g* project from the rear end portions of the black/white keys 3*a*/3*b.*

The acoustic upright piano 1 further comprises key action mechanisms 5, hammers 6, sets of strings 7 and damper mechanisms 8. The key action mechanisms 5 are associated with the black/white keys 3*a*/3*b,* respectively, and the capstan screws 3*g* transfer the key motions to the associated key action mechanisms 5. The hammers 6 are connected to the key action mechanisms 5, respectively, and are driven for rotation. When the hammers 6 escape from a jack (not shown) forming a part of the associated key action mechanisms 5, the key action mechanisms 5 give the unique key touch to the fingers of the player. The hammer 6 strikes the associated set of strings 7, and the set of strings 7 generates the acoustic sound. Though not shown in the drawings, a catcher projects from a butt of the hammer 6, and is linked with a bridle wire on a whippen assembly by means a bridle tape. After rebounding of the hammer 6 on the strings 7, the catcher is received by a back check block also projecting from the whippen, and the bridle tape makes the jack slide into the space beneath the butt.

The damper mechanisms 8 are used for damping the vibrations of the strings 7. The damper mechanisms 8 are linked with the black/white keys 3*a*/3*b*, respectively, and have respective damper heads. When the associated black/white keys 3*a*/3*b* are in the rest positions, the damper heads are held in contact with the sets of strings 7, and absorb the vibrations of the associated strings 7. A player depresses the black/white key 3*a*/3*b.* Then, the damper head is spaced from the associated set of strings 7, and the set of strings 7 is allowed to vibrate. The associated hammer 6 strikes the set of strings 7, and the strings 7 vibrate to generate the acoustic sound. When the player releases the black/white key 3*a*/3*b,* the black/white key 3*a*/3*b* starts to return toward the rest position. The damper bead is brought into contact with the set of strings 7, again, and damps the vibrations.

Silent System

The silent system 20 includes a controller 100, a catcher stopper 20*a* and an actuator 20*b.* The controller 10 is shared between the silent system 20 and the automatic playing system 30, and will be described in detail hereinlater. The catcher stopper 20*a* is installed over the butt, and laterally extends. The catcher stopper 20*a* is connected to a rotatable shaft 20*c* of the actuator 20*b,* and the controller 100 energizes the actuator 20*b* so as to rotate the shaft 20*c* in one of the two directions. The catcher stopper 20*a* is rotated together with the shaft 20*c,* and is changed between a block position BP and a free position FP. In FIG. 3, the catcher stopper 20*a* is in the free position FP, and the catcher stopper 20*a* in the block position is drawn by broken lines.

When the catcher stopper 20*a* reaches the block position BP, the catcher stopper 20*a* projects into the trajectory of the catcher. The catcher stopper 20*a* in the block position BP causes the catcher to rebound thereon between the escaping point and the striking point against the strings 7. On the other hand, when the actuator 20*b* rotates the catcher stopper 20*a* in the opposite direction, the catcher stopper 20*a* reaches the free position FP, and is out of the trajectory of the catcher. The catcher stopper is not any obstacle, and the hammer 6 can strike the associated set of strings 7.

Figure 1:
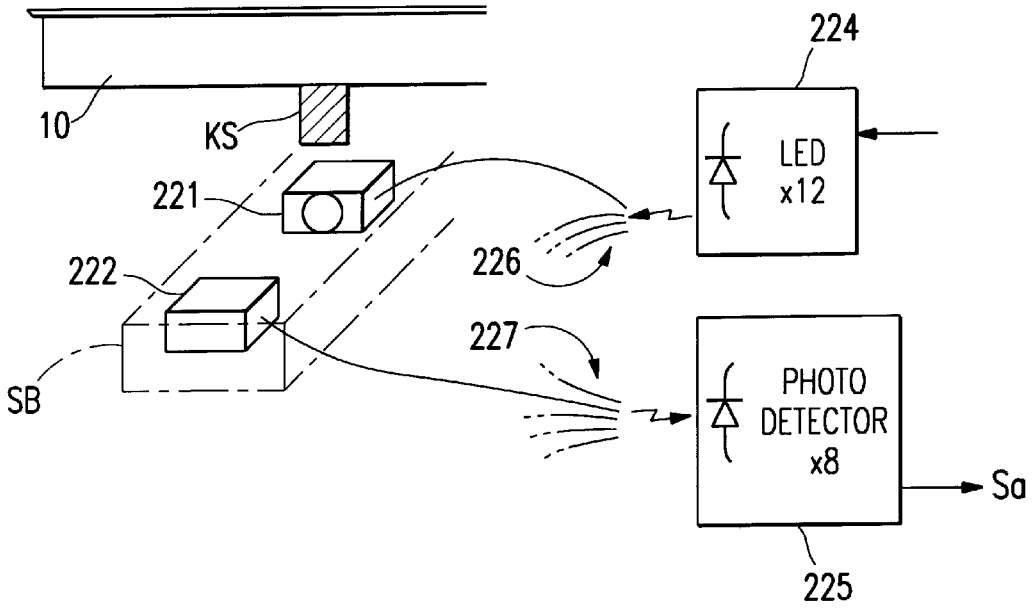
FIG. 1 PRIOR ART
FIG. 1 is a schematic view showing the prior art optical sensor matrix.

The silent system 20 further includes plural key sensors 90. The plural key sensors 90 are associated with the black/white keys 3*a*/3*b,* respectively, and the plural key sensors 90 are implemented by shutter plates 90*a* and an optical sensor matrix 90*b.* The shutter plates 90*a* are respectively attached to the lower surfaces of the black/white keys 3*a*/3*b,* and the optical sensor matrix 90*b* is mounted on the key bed 4*a.* The optical sensor matrix 90*b* is similar in structure to the optical sensor matrix shown in FIG. 1, and light emitting diodes 90*c,* a bundle of optical fibers 90*d,* light emitting sensor heads 90*e,* light receiving sensor heads 90*f,* a bundle of optical fibers 90*g* and photo-detecting diodes 90*h* form in combination the optical sensor matrix 90*b.* The key sensors 90 detect current positions of the associated black/white keys 3*a*/3*b,* and supply key position signals S1 representative of the current key positions to the controller 100. The controller 100 forms an audio signal S2 on the basis of the current key positions and variances thereof, and supplies the audio signal S2 to a headphone HH and/or a speaker system SP. The headphone HH and/or the speaker system SP generates electronic sound corresponding to the depressed keys 3*a*/3*b.* The key sensors 90 are shared between the silent system 20 and the automatic playing system 30 as will be described hereinbelow.

Automatic Playing System

The automatic playing system 30 includes the controller 100, the key sensors 90 and plural key actuators 30*a.* The key actuators 30*a* are respectively associated with the black/white keys 3*a*/3*b,* and are mounted on the key bed 4*a.* The key actuator 30*a* has a solenoid 30*b* and a plunger 30*c,* and the plunger 30*c* is retracted in the solenoid 30*b.* When the solenoid 30*b* is energized, the plunger 30*c* projects from the solenoid 30*b,* and pushes up the associated black/white key 3*a*/3*b.*

While the automatic playing system 30 is recording a performance on the keyboard 3, the key sensors 90 reports the current key positions through the key position signals S1 to the controller 100, and the controller 100 produces music data codes representative of the performance on the basis of the key position signals S1 and the variance thereof. The music data codes are stored in a suitable memory such as, for example, a floppy disk 110 (see FIG. 4). The original performance is reproduced in a playback mode. The controller 100 reads out the music data codes from the memory 110, and produces a driving voltage signals S3 on the basis of the music data codes. The driving voltage signals S3 are selectively supplied to the key actuators 30*a*, and the plungers 30*c* move the black/white keys 3*a*/3*b*.

Figure 4:
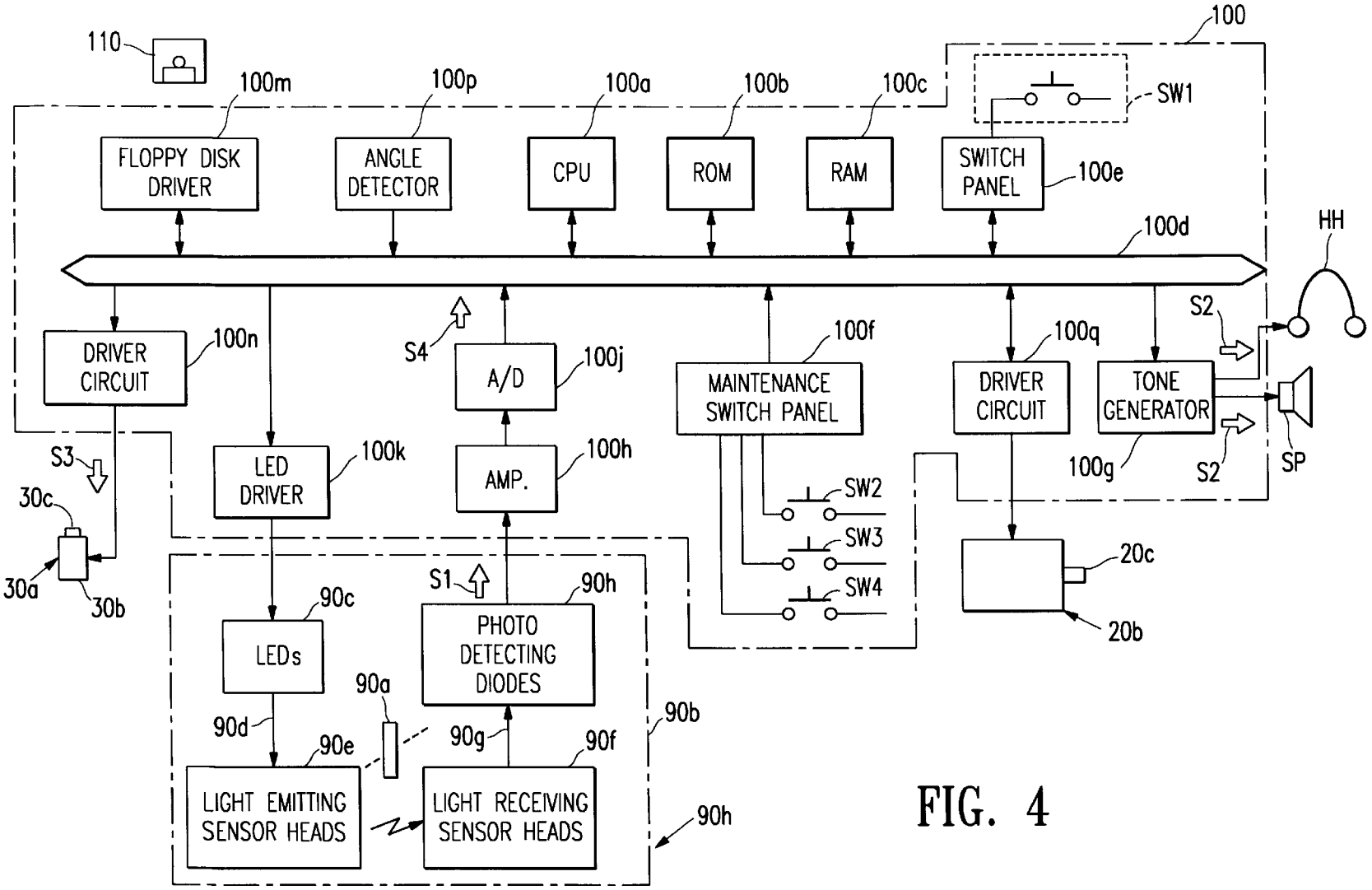
FIG. 4 is a block diagram showing the circuit arrangement of a controller incorporated in the automatic player piano.

FIG. 4 illustrates the controller 100. The controller 100 includes a central processing unit 100*a*, a read only memory 100*b* such as a flush memory, a random access memory 100*c* and a shared bus 100*d*. The central processing unit 100*a*, the read only memory 100*b* and the random access memory 100*c* are respectively abbreviated as "CPU", "ROM" and "RAM" in FIG. 4. The central processing unit 100*a* may be implemented by a microprocessor. The read only memory 100*b* stores programmed instructions, and various tables are defined in the read only memory 100*b*. The music data codes are temporarily stored in the random access memory 100*c*, and calculating results are also temporarily stored in the random access memory 100*c*. The central processing unit 100*a*, the read only memory 100*b* and the random access memory 100*c* are connected to the shared bus 100*d*. The central processing unit 100*a* sequentially fetches the programmed instructions through the shared bus 100*d*, and executes them for given jobs. The central processing unit 100*c* defines tables in the random access memory device during the execution of the programmed instructions.

The controller 100 further includes a switch panel 100*e*, and a push button switch SW1 is incorporated in the switch panel 100*e* together with other switches (not shown). The switch panel 100*e* is connected to the shared bus 100*d*, and user gives instructions from the switch panel 100*e* through the shared bus 100*d* to the central processing unit 100*a*. The user shifts the catcher stopper 20*a* between the block position BP and the free position FP by using the push button switch SW1.

The controller 100 further includes a maintenance switch panel 100*f*, and is also connected to the shared bus 100*d*. The maintenance switch panel 100*f* is provided inside the piano case, and is not exposed to the outside. For this reason, assembly workers and tuners usually manipulate switches SW2, SW3 and SW4 on the maintenance switch panel 100*f*. If the switches SW2, SW3 and SW4 are manipulated, the maximum voltage level $L_{M2}$, the voltage level $L_{R2}$ at the rest position and the voltage level $L_{E2}$ are measured.

The controller 100 further includes a tone generator 100*g*, which is also connected to the shared bus 100*d*. The central processing unit 100*a* supplies the pieces of music data information representative of a key code, velocity, key-on event, key-off event and a release rate to the tone generator, and the tone generator 100*g* produces a tone signal on the basis of the pieces of music data information. The tone generator 100*g* has sixteen channels, and each tone signal is formed through one of the channels. When the piece of music data information representative of the key-on event is supplied to the channel, the channel imparts parts of envelope called as "attack", "decay" and "sustain" to the tone signal. The channel controls the amplitude and the damping rate depending upon the velocity and the release rate, respectively. The tone signal is mixed with other tone signals, and these tone signals form the audio signal S2. Thus, the tone generator 100*g* concurrently produces sixteen tone signals at the maximum, and the headphone HH and/or the speaker system SP can generate sixteen electronic sounds. The audio signal S2 is supplied to the headphone HH and/or the speaker system SP, and the electronic sounds are radiated from the headphone HH and/or the speaker system SP. The tone color may be like an acoustic piano sound.

The controller 100 further includes an amplifier 100*h*, an analog-to-digital converter 100*j* and an LED driver 100*k*. The amplifier 100*h* is connected between the photo detecting diodes 90*h* and the analog-to-digital converter 100*j*, and the analog-to-digital converter 100*j* is connected to the shared bus 100*d*. The LED driver 100*k* is connected between the shared bus 100*d* and the light emitting diodes 90*c*. The central processing unit 100*a* instructs the LED driver 100*k* to sequentially energize the light emitting diodes 90*c*. The key position signals S1 are supplied through the amplifier 100*h* to the analog-to-digital converter 100*j*, and the analog-to-digital converter 100*j* converts the key position signals S to digital key position signals S4.

The optical sensor matrix 90 has twelve light emitting diodes 90*c* and eight photo detecting diodes 90*h*. The twelve light emitting diodes 90*c* and the eight photo detecting diodes 90*h* results in ninety-six combinations, and eighty-eight combinations are assigned to the eighty-eight black/white keys 3*a*/3*b*. The central processing unit 100*a* can specify the black/white keys 3*a*/3*b* just radiated with the light beams. Each of the twelve light emitting diodes is connected to eight light emitting sensor heads 90*e* through the optical fibers 90*d*, and the light beams are concurrently radiated from the eight light emitting sensor heads 90*e* toward the associated light receiving sensor heads 90*f*. The eighty-eight light receiving sensor heads 90*f* are divided into twelve sensor head groups, and each sensor head group, i.e., the eight light receiving sensor heads 90*f* are respectively connected to the eight photo-detecting diodes 90*h*.

The LED driver 100*k* sequentially energizes the twelve light emitting diodes 90*c*, and each light emitting diode 90*c* causes the eight light emitting sensor heads 90*e* to radiate the light beams toward the associated light receiving sensor heads 90*f*. For this reason, the eighty-eight black/white keys 3*a*/3*b* are radiated with the light beams eight by eight. The radiation with the eight light beams is hereinbelow referred to as "scanning". The eight light receiving sensor heads 90*f* concurrently receive the light beams, and the eight optical fibers 90*g* propagate the light to the eight photo detecting diodes 90*h*. Thus, the eight key position signals S1 are concurrently supplied through the amplifier 100*h* to the analog-to-digital converter 100*j*. However, only four analog-to-digital converting units are incorporated in the analog-to-digital converter 100*j*. The eight key position signals S1 is divided into two groups, and the four key position signals S1 are concurrently converted to the four digital key position signals S4. For this reason, the central processing unit 100*a* fetches the four digital key position signals S4 twice a scanning.

The central processing unit 100*a* repeatedly fetches the digital key position signals S4 representative of the current positions of the eighty-eight black/white keys 3*a*/3*b*, and determines the key code, the velocity, the key-on event, the key-off event and the release rate for each of the depressed keys 3*a*/3*b*. The central processing unit 100*a* produces the music data codes from the pieces of music data information representative of the key code, the velocity, the key-on event, the key-of event and the release rate. In this instance, the music data codes are formatted in accordance with the MIDI (Musical Instrument Digital Interface) standards.

The controller 100 further includes a floppy disk driver 100*m* and a driver circuit 100*n* for the key actuators 30*a*. The music data codes are transferred to the floppy disk driver 100*m* in the recording mode, and the floppy disk driver 100*m* stores the music data codes in the floppy disk 110. On the other hand, the floppy disk driver 100*m* reads out the music data codes from the floppy disk 110, and transfers them to the random access memory 100*c*. The music data codes are temporarily stored in the random access memory

100*c*. The music data codes are sequentially read out from the random access memory 100*c*, and the central processing unit 100*a* instructs the driver circuit 100*n* to selectively supply the driving voltage signal S3 to the key actuators 30*a*.

The solenoid 30*b* is energized with the driving voltage signal S3, and the plunger 30*c* projects from the solenoid 30*b*. The plunger 30*c* pushes up the associated black/white key 3*a*/3*b*, and moves it without player's fingering. In this instance, the black/white key 3*a*/3*b* is moved in the predetermined range such as, for example, 10 millimeters, and the shutter plate 90*a* is also moved in the predetermined range such as, for example, 5 millimeters.

The controller 100 further includes an angle detector 100*p* and a driver circuit 100*q* for the actuator 20*b*. The driver circuit 100*q* supplies electric power to the actuator 20*b*, and changes the polarity depending upon the rotating direction of the shaft 20*c*. The angle detector 100*p* monitors the catcher stopper 20*a*, and reports the current angular position of the catcher stopper 20*a* to the central processing unit 100*a*. When the catcher stopper 20*a* enters the block position BP or the free position FP, the central processing unit 100*a* instructs the driver circuit 100*q* to stop the rotation.

Figure 5:
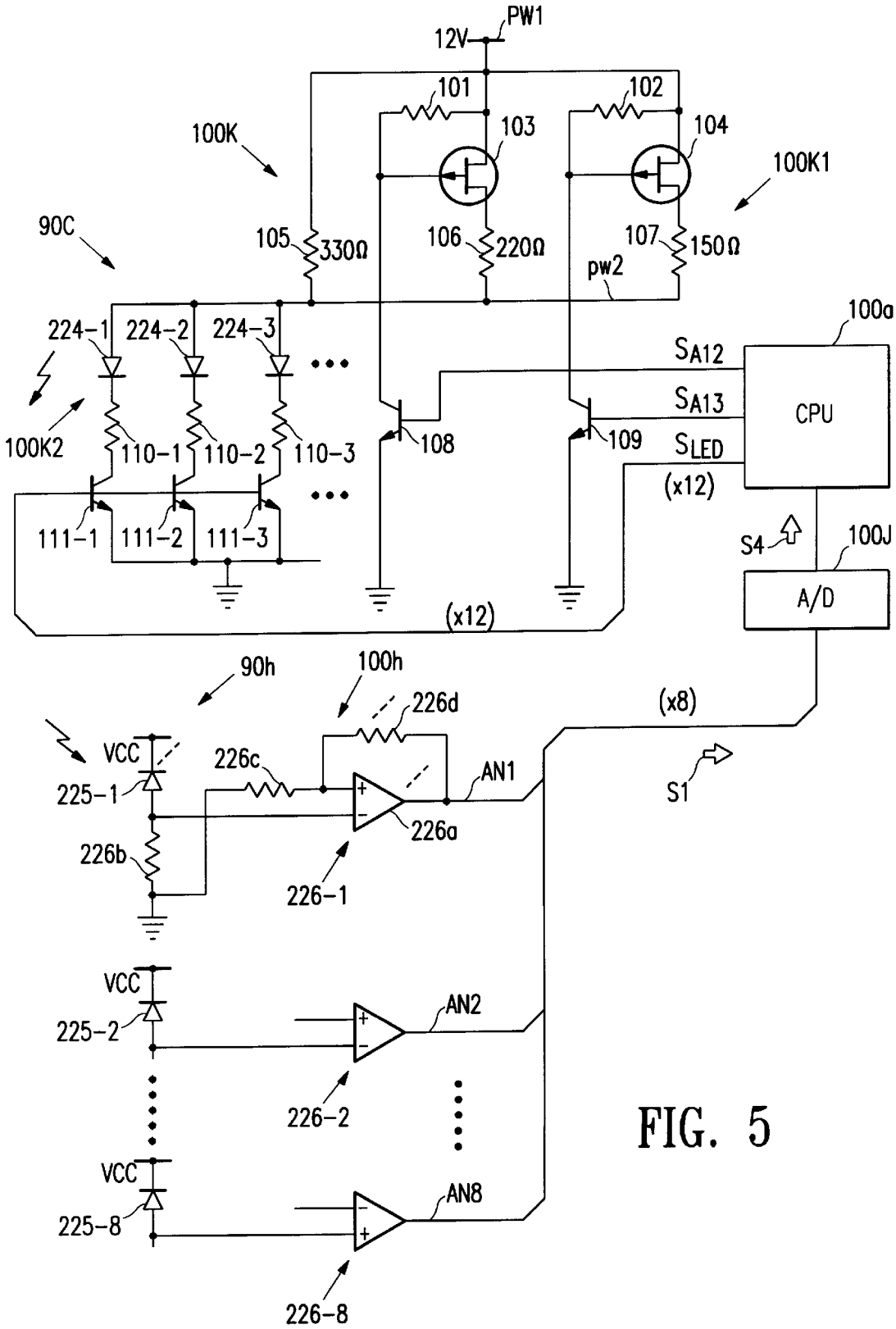
FIG. 5 is a circuit diagram showing the circuit configuration of an LED driver, light-emitting diodes, photo-detecting diodes and an amplifier.

FIG. 5 illustrates the circuit configuration of the LED driver 100*k*, the optical sensor matrix 90, the amplifier 100*h* and the analog-to-digital converter 100*j*. The light emitting diodes 90*c* are individually labeled with 224-1, 224-2, 224-3, . . . , and the photo-detecting diodes 90*h* are individually labeled with 225-1, 225-2, . . . and 225-8.

The amplifier 100*h* has eight amplifier units 226-1, 226-2 . . . 226-8, and the eight amplifier units 226-1 to 226-8 are similar in circuit configuration to one another. For this reason, only one amplifier unit 226-1 is detailed hereinbelow. An operational amplifier 226*a* and three resistors 226*b*, 226*c* and 226*d* form in combination the amplifier unit 226-1. The resistor 226*b* is connected between the anode of the associated photo detecting diode 225-1 and the ground line. The anode of the photo detecting diode 225-1 is connected to the inverted node of the operational amplifier 226*a*, and the ground line is connected through the resistor 226*c* to the non-inverted node of the operational amplifier 226*a*. The resistor 226*d* is connected between the output node AN1 of the operational amplifier 226*a* to the inverted node. When the light beam is incident on the associated photo detecting diode 225-1, photocurrent flows through the resistor 226*b*, and the resistor 226*b* converts the photo current to a voltage. The voltage is applied to the non-inverted node of the operational amplifier 226*a*. The operational amplifier 226*a* amplifies the voltage level at the non-inverted node, and the resistors 226*c* and 226*d* determine the gain of the operational amplifier 226*a*. The output voltage of the operational amplifier 226*a* is supplied from the output node AN1 to the analog-to-digital converter 100*j*.

The LED driver 100*k* is broken down into a current controlling circuit 100*k*1 and a selector 100*k*2. The current controlling circuit 100*k*1 includes p-channel enhancement type field effect transistors 103/104, n-p-n bipolar transistors 108/109 and resistors 101/102/105/106/107. The resistor 105, the series combination of the n-p-n bipolar transistor 103 and the resistor 106 and the series combination of the n-p-n bipolar transistor 104 and the resistor 107 are connected in parallel between a power supply line PW and a power distribution line PW2. The power distribution line PW2 is connected to the anodes of the light emitting diodes 224-1, 224-2, 224-3, . . . . The resistor 101 is associated with the p-channel enhancement type field effect transistor 103, and is connected between the source node and the gate electrode. Similarly, the resistor 102 is associated with the other p-channel enhancement type field effect transistor 104, and is connected between the source node and the gate electrode. The n-p-n bipolar transistors 108/109 are connected between the gate electrodes of the p-channel enhancement type field effect transistors 103/104 and the ground line. The central processing unit 100*a* supplies control signals $S_{A12}$ and $S_{A13}$ to the base nodes of the n-p-n bipolar transistors 108/109, respectively. In this instance, the resistors 105/106/107 are 330 ohms, 220 ohms and 150 ohms, respectively.

The central processing unit 100*a* selectively changes the control signals $S_{A12}$ and $S_{A13}$ between the ground level and a positive high level. When the central processing unit 100*a* keeps both control signals $S_{A12}$ and $S_{A13}$ in the ground level, the n-p-n bipolar transistors 108/109 are turned off, and cause the gate electrodes of the p-channel enhancement type field effect transistors 103/104 to be equal in voltage level to the source nodes. As a result, the p-channel enhancement type field effect transistors 103/104 are turned off, and the electric current flows form the power supply line PW1 through the resistor 105 to the power distribution line PW2. If the central processing unit 100*a* changes the control signal $S_{A12}$ to the positive high level, the n-p-n bipolar transistor 108 turns on, and electric current flows through the resistor 101 and the n-p-n bipolar transistor 108 to the ground line. The resistor 101 causes the gate electrode of the p-channel enhancement type field effect transistor 103 to be lower than the source node thereof, and the p-channel enhancement type field effect transistor 103 turns on. As a result, another current path is offered in parallel to the resistor 105, and the electric current flows through the p-channel enhancement type field effect transistor 103 and the resistor 106 into the power distribution line PW2. The total resistance against the electric current is equivalent to 132 ohms, i.e., 330//220.

When the central processing unit 100*a* respectively changes the control signal lines $S_{A12}$ and $S_{A13}$ to the ground level and the positive high level, the other n-p-n bipolar transistor 109 turns on, and, accordingly, the associated p-channel enhancement type field effect transistor 104 turns on. The n-p-n bipolar transistor 108 and, accordingly, the p-channel enhancement type field effect transistor 103 turn off. The p-channel enhancement type field effect transistor 104 and the resistor 107 offers another current path to the power distribution line PW2. The total resistance against the current is equal to 103 ohms.

When the central processing unit 100*a* changes both control signal lines $S_{A12}$ and $S_{A13}$ to the positive high level, both n-p-n bipolar transistors 108/109 turn on, and, accordingly, both p-channel enhancement type field effect transistors 103/104 turn on, and the electric current flows through the three current paths into the power distribution line PW2. The total resistance against the electric current is equal to 70 ohms. Thus, the central processing unit 100*a* selectively changes the control signals $S_{A12}$ and $S_{A13}$ to the positive high level, and varies the amount of current flowing into the power distribution line PW2.

The selector 100*k*2 includes series combinations of resistors 110-1/110-2/110-3/ . . . and n-p-n bipolar transistors 111-1/111-2/111-31 . . . . The series combinations are connected between the cathodes of the light emitting diodes 224-1/224-2/224-3/ . . . and the ground line. The central processing unit 100*a* has twelve control signal lines $S_{LED}$ connected to the base nodes of the n-p-n bipolar transistors 111-1, 111-2, 111-3, and sequentially changes the twelve control signal lines $S_{LED}$ to the positive high level. The n-p-n bipolar transistors 111-1, 111-2, 111-3, . . . sequentially turn on, and the light emitting diodes 224-1, 224-2, 224-3, . . . are also sequentially energized so as to emit the light beams.

Offset Current

Figure 6:
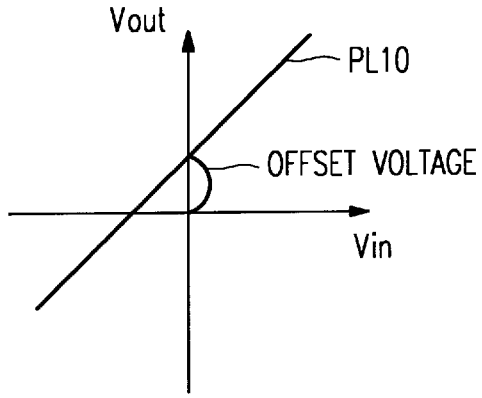
FIG. 6 is a graph showing input voltage-to-output voltage characteristics of an operational amplifier incorporated in the amplifier.

An ideal operational amplifier has an inverted input node and a non-inverted input node imaginary short-circuited. The photo detecting diode 90*h* is assumed to be associated with the ideal operational amplifier. While any light does not fall into the photo-detecting diode 90*h,* any electric current does not flow, and the input voltage and, accordingly, the output voltage are zero. However, the actual operational amplifiers 226*a* has input voltage-to-output voltage characteristics indicated by plots PL10 (see FIG. 6). Vin and Vout represent the input voltage and the output voltage, respectively. The plots PL10 does not pass the origin, and the output voltage Vout has a positive value. The positive value is the offset voltage. The output voltage Vout at the output node AN1/AN2/ . . . /AN8 contains the offset voltage at all times.

Figure 7:
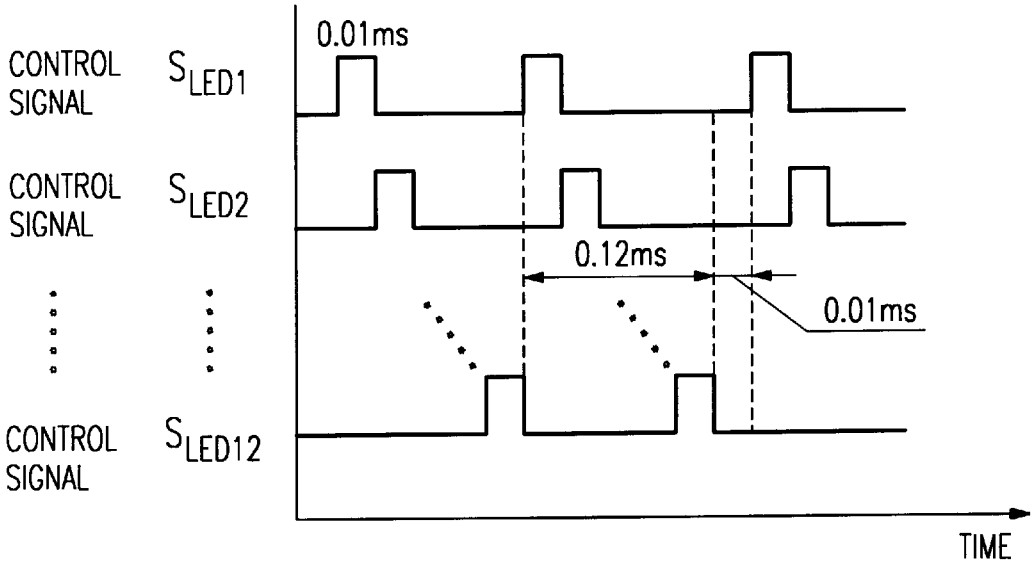
FIG. 7 is a timing chart showing control signals for sequentially selecting the light-emitting diodes.

In order to exactly determine the current key position on the basis of the key position signal S1, it is necessary to eliminate the offset voltage from the output voltage Vout. In this instance, the central processing unit 100*a* periodically measures the offset voltage as shown in FIG. 7. The central processing unit 100*a* sequentially changes the control signals $S_{LED1}$, $S_{LED2}$ . . . and $S_{LED12}$ to the positive high level. The control signals $S_{LED1}$, $S_{LED2}$ . . . and $S_{LED12}$ causes the light-emitting diodes 224-1, 224-2, 224-3, . . . to radiate the light beams, respectively, as described hereinbefore. The time period for sequentially illuminating the light-emitting diodes 90*c* is hereinbelow referred to as "scanning cycle". The control signals $S_{LED1}$, $S_{LED2}$, . . . and $S_{LED12}$ have the pulse width of 0.01 millisecond, and each control signal $S_{LED1}$, $S_{LED2}$, . . . or $S_{LED12}$ regularly rises at intervals of 0.12 milliseconds. In this instance, the regular scanning cycle is 0.12 milliseconds. The central processing unit 100*a* prolongs the interval once a minute. Namely, an irregular scanning cycle of 0.13 milliseconds is inserted one a minute. This means that all the central processing unit 100*a* extinguishes all the light-emitting diodes 90*c* for 0.01 millisecond. While the central processing unit 100*a* is extinguishing all the light-emitting diodes 90*c,* the input voltage Vin is zero, and the operational amplifiers 226*a* change the key position signals S1 to values of the offset voltage. The key position signals S1 are converted to the digital key position signals S4, and the central processing unit 100*a* fetches the digital key position signals S4 representative of the values of the offset voltage. The central processing unit 100*a* transfers the digital key position signals S4 to the random access memory 100*c,* and stores them in the random access memory 100*c* as pieces of control data information representative of the current values of the offset voltage. Thus, the central processing unit 100*a* renews the pieces of control data information at the intervals of one minute.

While the central processing unit 100*a* is recording a performance, the central processing unit 100*a* subtracts the current value of the offset voltage from the value of the digital key position signal S4 representative of the current key position. Thus, the central processing unit 100*a* compensates the digital key position signals S4 for the offset voltage of the associated operational amplifiers 226*a,* and produces the pieces of music data information free from the offset voltage.

The current key position is, by way of example, used for calculation of a velocity of a depressed key 3*a*/3*b*. The central processing unit 100*a* requires two current key positions spaced apart on the trajectory of the depressed key, a time at which the one of the current key positions was measured and a time at which the other current key position was measured. The insertion of irregular scanning cycle delays the regular scanning cycles by 0.01 millisecond. However, the central processing unit 100*a* requires 0.12 milliseconds for the data acquisition from the eighty-eight black/while keys 3*a*/3*b*. The delay of 0.01 millisecond is ignoreable. Of course, the central processing unit 100*a* may correct the time in the calculation of the velocity.

Initial LED Characteristics

Figure 2:
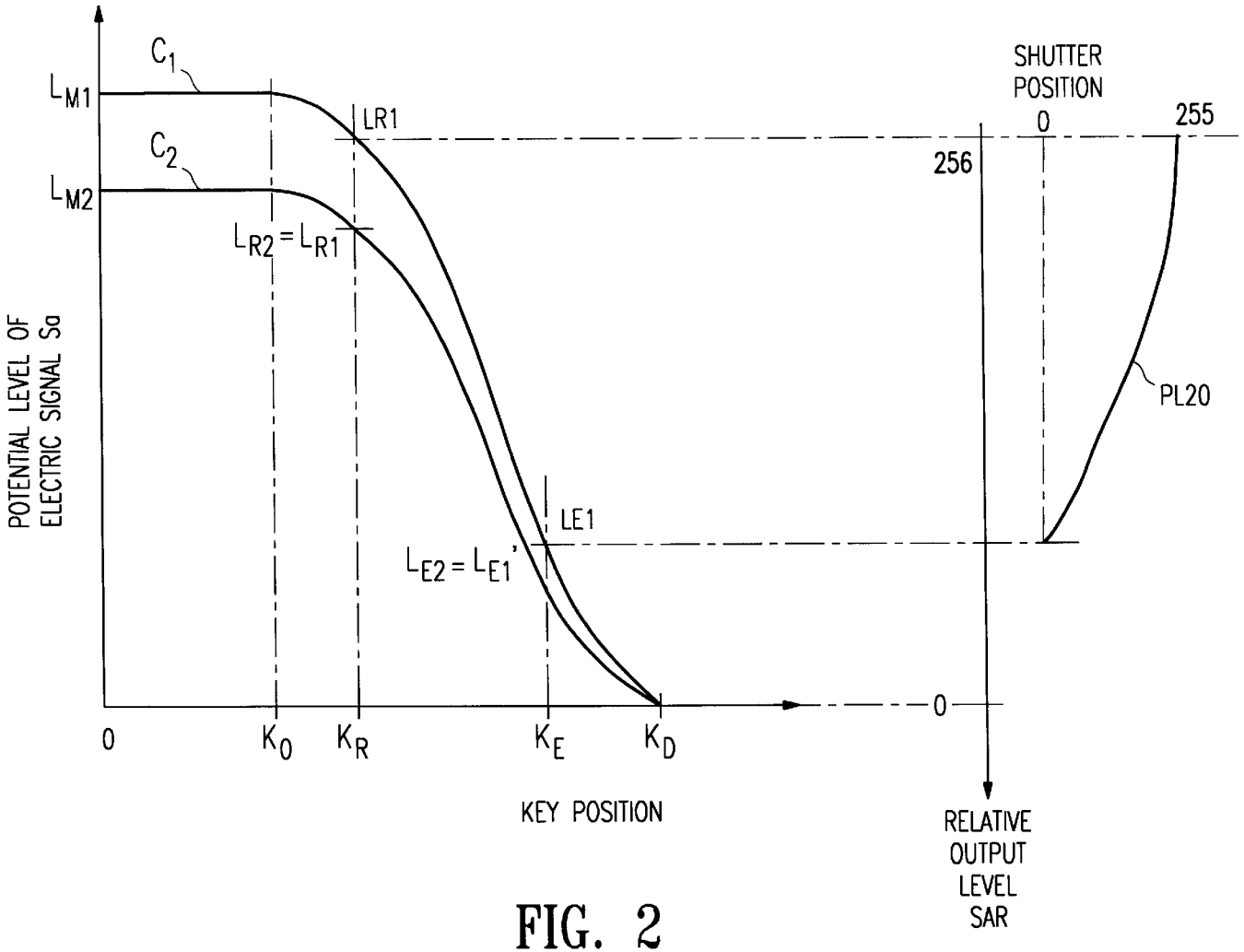
FIG. 2 is a graph showing the position-to-voltage converting characteristics varied with time and a rectifying curve according to the present invention.

The manufacturer determines initial position-to-voltage converting characteristics C1 (see FIG. 2) for each of the key sensors 90, and stores pieces of control data information representative of the initial characteristics C1 in the read only memory 100*b* or the flush memory.

Before mounting the keyboard 3 on the key bed 4*a,* the manufacturer places the optical sensor matrix 90 on the key bed 4*a,* and attaches the shutter plates 90*a* to the piano case. The manufacturer moves the shutter plates 90*a* between the light-emitting sensor heads 90*e* and the associated light receiving sensor heads 90*f*. The shutter plates 90*a* are moved at intervals of 0.15 millimeter. In other words, the shutter plates 90*a* offer forthy-seven sampling points on the trajectory of 7 millimeters. The central processing unit 100*a* instructs the LED driver 100*k* to sequentially radiate the light-emitting diodes 90*c* at every sampling point, and fetches the digital key position signals S4. The central processing unit 100*a* stores the values at every sampling point in the random access memory 100*c*.

Subsequently, the central processing unit 100*a* calculates the moving average for smoothing. When the central processing unit 100*a* calculates the moving average at a certain sampling point, the central processing unit 100*a* reads out the values from the certain sampling point, the previous three sampling points and the next three sampling points, and the read-out values are averaged. As a result, the noise is eliminated from the sampling values. If the sampling values are saturated, the central processing unit 100*a* appropriately changes the control signals $S_{A12}$ and $S_{A13}$ so as to reduce the electric current supplied to the light-emitting diodes 90*c*. Thus, the central processing unit 100*a* optimizes the amount of electric current flowing into the light-emitting diodes 90*c*. If the maximum sampling value is out of the allowable range or the position-to-voltage converting characteristics C1 are quite different, the optical sensor matrix possibly contains defective part or parts, and the manufacturer replaces the defective parts with new parts.

Subsequently, the central processing unit selects a sampling point at the mid point of the stroke of the shutter plate 90*a* as follows. The central processing unit 100*a* firstly determines the highest sampling point with the maximum value and the lowest sampling point with the minimum value. Subsequently, the central processing unit 100*a* selects the first sampling point, which has the sampling value 15 percent larger than the minimum sampling value. The central processing unit 100*a* further selects the second sampling point, which has the sampling value 15 percent smaller than the maximum sampling value. The central processing unit 100*a* calculates the mean value between the first sampling point and the second sampling point, and selects a sampling point with the sampling value closest to the mean value. The selected sampling point is the sampling point at the mid point.

Subsequently, the central processing unit 100*a* selects sixty-four sampling points around the selected sampling point, and the sampling values at the sixty-four sampling points are stored in the read only memory 100*b*. The selected sampling value at the mid sampling point is stored at AD[31], and the sixty-four sampling values are stored at AD[0] to AD[63]. The maximum sampling value is also stored in the read only memory 100*b* as the maximum level $L_{M1}$.

The black/white keys 3*a*/3*b* are depressed, and the shutter plates 90*a* reach the peripheries of the light beams. If the black /white keys 3*a*/3*b* are further depressed, the sampling values are decreased. The central processing unit 100*a* determines the key position with the sampling value immediately before the decrease to be an open position Ko (see FIG. 2) for the black/white key 3*a*/3*b*. The open positions Ko are stored in the read only memory 100*b*.

The black/white keys 3*a*/3*b* are further depressed. When the sampling value reaches zero, the central processing unit 100*a* determines the key position to be a perfectly closed position $K_D$ of the black/white key 3*a*/3*b*. The perfectly closed position $K_D$ is stored in the read only memory 100*b*. The above-described steps are repeated, and the central processing unit 100*a* determines the position-to-voltage converting characteristics C1, the values of the maximum level LM1, the open positions Ko and the perfectly closed positions $K_D$ for all the black/white keys 3*a*/3*b*. Subsequently, the manufacturer attaches the shutter plates 90*a* to the lower surfaces of the black/white keys 3*a*/3*b*, and the keyboard 3 is mounted on the key bed 4*a*.

Manual Regulation

The light-emitting diodes 90*c* vary the intensity due to the aged deterioration. The aged deterioration is observed during the fabrication of the automatic player piano. For this reason, the manufacturer manually regulates the position-to-voltage converting characteristics at the final stage of the fabrication as follows.

First, the operator lifts up the keyboard 3, and the shutter plates 90*a* are sufficiently spaced from the light-emitting sensor heads 90*e* and the light receiving sensor heads 90*f*. The operator pushes the switch SW2. Then, the central processing unit 100*a* instructs the LED driver 100*k* to sequentially energize the twelve light-emitting diodes 90*c*. The light-emitting sensor heads 90*c* respectively radiate the light beams to the light-receiving sensor heads 90*f* without any intersection of the shutter plates 90*a*, and the photo-detecting diodes 90*h* convert the received light to the key position signals S1. The key position signals S1 and, accordingly, the digital key position signals S4 are indicative of the maximum level $L_{M2}$. The values of the maximum level $L_{M2}$ are stored in the random access memory 100*c*.

Subsequently, the operator mounts the keyboard 3 on the key bed 4*a*, again, and pushes the switch SW3. Then, the central processing unit 1 0 0*a* instructs the LED driver 100*k* to sequentially energize the twelve light-emitting diodes 90*c*, a gain. The digital key position signals S4 are indicative of the voltage levels $L_{R2}$ at the rest position $K_R$. The voltage levels $L_{R2}$ are stored in the random access memory 100*c*.

Finally, the operator depresses the eighty-eight black/white keys 3*a*/3*b*, and the eighty-eight black/white keys 3*a*/3*b* reach the end positions $K_E$. The operator pushes the switch SW4. Then, central processing unit 100*a* instructs the LED driver 100*k* to sequentially energize the twelve light-emitting diodes 90*c*, and the digital key position signals S4 are indicative of the voltage levels $L_{E2}$ at the end positions $K_E$. The voltage levels $L_{E2}$ are stored in the random access memory 100*c*.

The central processing unit 100*a* determines a rest position level $L_{R1}$ and an end position level $L_{E1}$ on the position-to-voltage converting characteristics C1. The rest position level $L_{R1}$ and the end position level $L_{E1}$ are given as $$L_{R1}=L_{R2}\times L_{M1}/L_{M2}$$

$$L_{E1}\mathbf{32}\ L_{E2}\times L_{M1}/L_{M2}$$

The black/white keys 3*a*/3*b* are equal in stroke to one another, and, accordingly, the shutter plates 90*a* are also equal to one another. The central processing unit 100*a* may determine only the end position level $L_{E1}$, because the central processing unit 100 can calculate the other levels. The central processing unit 100*a* may determine the rest position level $L_{R1}$ instead of the end position level $L_{E1}$.

Subsequently, the central processing unit 100*a* produces a linearization table represented by plots PL20. The abscissa is indicative of the shutter position, and the axis of coordinates is indicative of a relative output level SAR of the key sensors 90. The relative output level SAR has unit value equal to the quotient of a division where the difference between the binary value $L_{R2}$ and binary value at the key position the $K_D$ i.e., zero, is divided by 256. When the binary key position signal S4 reaches zero, the relative output level SAR is zero. The relative output level SAR is 256 at the binary value $L_{R2}$. The shutter position is determined on the basis of the position-to-voltage converting characteristics C1. The shutter position is zero at the end position $K_E$ and 255 at the rest position $K_R$. The plots PL20 is obtained through the linear interpolation between the sampling points for the position-to-voltage converting characteristics. Although the shutter position is to be simply increased with respect to the relative output level SAR, there is a possibility that the interpolation results in decrease of the shutter position inversely to the relative output level SAR due to the noise imperfectly eliminated. A shutter position SPx is assumed to be decreased inversely to the relative position SARx. The central processing unit 100*a* assumes the shutter position SPx to be equal to the previous shutter position SPx-1 at the relative output level SARx-1, which is one point before the corresponding relative output level SARx.

Determination of Shutter Position in Performance

While a player is performing a tune on the keyboard 3, the central processing unit 100*a* instructs the LED driver 100*k* to sequentially energize the light-emitting diodes 90*c*, and the key sensors 90 check the eighty-eight black/white keys 3*a*/3*b* to see whether they change the key positions. The key sensors 90 supply the key position signals S1 through the amplifier 100*h* to the analog-to-digital converter 100*j*, and the analog-to-digital converter 100*j* are fetched by the central processing unit 100*a*. The central processing unit 100*a* compensates the binary value of the digital key position signal S4 for the offset voltage. The central processing unit 100*a* determines the current key position of each black/white key 3*a*/3*b* as follows. First, the central processing unit 100*a* determines the relative output level SAR as $$SAR=Sa\times 256/L_{R2}$$

where Sa is the binary value of the digital key position signal S4. The relative output level SAR is rounded, and is represented by an integer. The central processing unit 100*a* checks the linearization table so as to determine the shutter position, i.e., the current key position.

The central processing unit 100*a* stores the current key positions in the random access memory device 100*c*, and produces the music data codes from the current key positions and the variances of the current key positions. Japanese Patent Publication of Unexamined Application No. 9-54584 discloses how the central processing unit 100*a* determines a note-on timing, i.e., the key-on timing, a note-off timing, i.e., the key-off timing and the velocity. For this reason, no further description is hereinbelow incorporated for the sake of simplicity.

Automatic Detection of Output Level $L_{R2}$

The maximum level LM2, the output level $L_{R2}$ at the rest position and the output level $L_{E2}$ at the end position are stored in the memory 100*b* before the delivery from the factory. They may be renewed during the tuning work. In this instance, the voltage level $L_{R2}$ is automatically renewed in the usual usage. The central processing unit 100*a* periodically checks the binary values of the digital key position signals S4 representative of the rest positions $K_R$ of the black/white keys 3*a*/3*b* to see whether or not the digital key position signals S4 vary the binary values. If one of the key sensors 90 keeps the digital key position signal S4 at a certain binary value for a predetermined time period, the central processing unit 100*a* determines the certain binary value to indicate the current rest position $K_R$, and changes the voltage level $L_{R2}$. As a result, the controller 100 according to the present invention can cope with the variation of the light intensity of the light-emitting diodes 90*c* in a short span.

Automatic Regulation of Light Intensity

As described hereinbefore, the light-emitting diodes 90*c* emit the light, and the light-emitting sensor heads 90*e* radiate the light beams to the light-receiving sensor heads 90*f*. Each of the light-receiving sensor heads 90*f* transfers the received light to the associated photo-detecting diode 90*h*, and the received light is converted to the key position signal S1. Thus, the amount of light received is converted to the magnitude of the key position signal S1. The reliability of the key position signal S1 is dependent on the stability of the light intensity of the light emitted from the light-emitting diodes 90*c* under the circumstances. However, the electric power-to-light converting characteristics of the light-emitting diodes 90*c* are unavoidably dispersed. This means that the light-emitting diodes 90*c* do not always achieve a target light intensity under a well-regulated electric current. When the light intensity is too large, the amplified key position signal S1 exceeds the upper limit of the analog-to-digital converter 100*j*, and the central processing unit 100*a* can not exactly determine the current key position. Of course, if the current controlling circuit 100*k*1 is well regulated to the light-emitting diode 90*c* with the maximum luminous efficiency, it is possible to restrict the amplified key position signals S1 under the upper limit of the analog-to-digital converter 100*j*. However, such a regulation is undesirable for the light-emitting diode 90*c* with the minimum luminous efficiency. Because, the key sensors 90 do not sufficiently swing the key position signals S1. This results in a low resolution of the current key position.

The controller 100 stores optimum light-emitting conditions of each light-emitting diode 90*c* in the random access memory 100*c*. A combination of the control signals SA12/SA13 define the light-emitting conditions. When the central processing unit 100*a* selects one of the n-p-n bipolar transistors 111-1/111-2/111-3/ . . . and, accordingly, the associated light-emitting diode 110-1 1 110-2/110-3/ . . . , the central processing unit 100*a* reads out the optimum electric conditions from the random access memory 100*c*, and changes the control signals SA12/SA13. As a result, every light-emitting diode 90*c* radiates the light under the optimum electric conditions, and the key sensors 90 swing the key position signals S1 in the full dynamic range of the analog-to-digital converter 100*j* without exceeding it.

Automatic Regulation of Light-Emitting Conditions

The light-emitting conditions for each light-emitting diode 90*c* is automatically regulated as follows. The central processing unit 100*a* monitors each of the digital key position signals S4 at all times to see whether or not the binary value thereof reaches the maximum binary value of the analog-to-digital converter 100*j*. If the binary value of a digital key position signal S4 reaches the maximum binary value, the central processing unit 100*a* changes the light-emitting conditions. The light-emitting conditions are assumed to require both control signals SA12/SA13 at the positive high level for the optimum light-emitting conditions. When the binary value reaches the upper limit under the optimum light-emitting conditions, the central processing unit 100*a* changes the optimum light-emitting conditions where one of the control signals SA12/SA13 is changed to the inactive ground level. As a result, the associated digital key position signals S4 swings the binary values under the upper limit.

As described hereinbefore, if the digital key position signal S4 at the rest position changes the binary value to a different binary value for a certain period, the central processing unit 100*a* employs the different binary value as the output level $L_{R2}$. When the output level $L_{R2}$ is too low, the central processing unit 100*a* changes the light-emitting conditions in such a manner as to decrease the equivalent resistance. As a result, the electric current is increased, and the output level $L_{R2}$ is pulled up.

As will be understood from the foregoing description, the controller 100 according to the present invention automatically regulates the output level $L_{R2}$ and the optimum light-emitting conditions. The automatic regulations enhance the stability of the total amount of light radiated from the light-emitting diodes 90*c* and the reliability of the relation between the relative output level SAR and the shutter/current key position. If the central processing unit 100*a* directly determines the current key position on the basis of the binary value of the digital key position signal S4, the regulation of the optimum light emitting conditions destroys the relation between the binary value and the current key position, and the central processing unit 100*a* can not exactly determine the current key position. However, the central processing unit 100*a* calculates the relative output level SAR by using $SAR=Sa\times256/L_{R2}$. The central processing unit 100*a* stores the relation between the relative output level SAR and the current shutter/key position, and determines the current shutter/key position on the basis of the relative output level SAR. For this reason, the regulation of the optimum light emitting conditions does not have serious influence on the current shutter/key position.

The position sensing device according to the present invention is applied to the automatic player piano for exactly detecting the current key positions. However, the position sensing device is not limited to the detection of the current key positions. Various kinds of manipulators are incorporated in musical instruments, and the current position of the manipulator usually has influences on the sounds. The position sensing device according to the present invention enhances the reliability of the current position, and is desirable for the manipulators. The position sensing device is, by way of example, provided to foot pedals, i.e., a soft pedal and a damper pedal of an automatic player piano or a silent piano.

In the above-described embodiment, the amount of light is the physical quantity varied together with the position of the manipulator. The black/ white keys 3*a*/3*b* serve as plural manipulators. The monitored range is equivalent to a region from $K_O$ to $K_D$. Attribute of sound means a note and loudness. The key sensors 90, the LED driver 100*k*, the amplifier 100*h*, the analog-to-digital converter 100*j*, the central processing unit 100*a*, the read only memory 100*b* and the random access memory 100*c* as a whole constitute the position sensing device. The current controlling circuit $\mathbf{100}_k\mathbf{1}$ serves as a variable power supply means. A first instruction is represented by the control signals $S_{A12}/S_{A13}$. A second instruction is represented by the control signals $S_{LED}$.

Although a particular embodiment of the present invention has been shown and described, it will be obvious to those skilled in the art that various changes and modifications may be made without departing from the spirit and scope of the present invention.

For example, the position sensing device may be incorporated in a silent piano (see U.S. Pat. No. 5,374,775, by way of example). The silent system may be eliminated from the automatic player piano according to the present invention. The position sensing device may be incorporated in an electric keyboard for electronically generating sounds.

The current controlling circuit 100*k*1 may have more than two series combinations of the p-channel enhancement type field effect transistors 103/104 and the resistors 106/107 associated with the n-p-n bipolar transistors 108/109.

What is claimed is:

1. A musical instrument comprising:

plural manipulators movable within respective monitored ranges, and selectively manipulated by a player for specifying an attribute of sound; and a position sensing device including plural sensors respectively provided for said plural manipulators and respectively creating said monitored ranges, a physical quantity in each of said monitored ranges being varied depending upon a current position of associated one of said manipulators, and a controller, said controller capable of:

storing a first relation between the amount of said physical quantity and the current positions of said manipulators, storing a second relation between a relative value of said amount of the physical quantity and said current positions of said manipulators, and determining the current position of each manipulated manipulator on the basis of the amount of physical quantity supplied from associated one of said plural sensors, wherein said controller calculates said relative value on the basis of said amount of the physical quantity supplied from said associated one of said plural sensors for determining said current position of said each manipulated manipulator.

2. The musical instrument as set forth in claim 1, wherein said first relation is variable over time, and wherein said controller changes said second relation when said first relation is varied.

3. The musical instrument as set forth in claim 1, in which a reference value of said amount of physical quantity is predetermined at a reference current position in said first relation, and said controller calculates said relative value by using an equation expressed as $SAR=Sa\times N/L_{R2}$ where SAR is said relative value, Sa is the amount of physical quantity, N is an integer and $L_{R2}$ is said reference value.

4. The musical instrument as set forth in claim 3, in which said controller periodically checks said reference value to see whether or not said reference value is varied to a new reference value, and uses said new reference value if said new reference value is continued for a certain time period.

5. The musical instrument as set forth in claim 3, in which said position sensing device further includes a variable power supply means connected to said plural sensors and responsive to a first instruction of said controller for varying the maximum physical quantity generated by said plural sensors and a selector connected to said plural sensors and responsive to a second instruction of said controller for selectively activating said plural sensors, and said controller stores first pieces of control data information representative of optimum powers to be applied to said plural sensors, respectively, so as to energize each of said plural sensors with the optimum power when said selector selects said each of said plural sensors.

6. The musical instrument as set forth in claim 5, in which said controller periodically checks said physical quantity in each of said monitored range to see whether or not the optimum power is appropriate to associated one of said plural sensors, and changes said optimum power if said optimum power is inappropriate.

7. The musical instrument as set forth in claim 1, in which said plural manipulators are keys movable between respective rest positions and respective end positions along trajectories, and each of said plural sensors has a light-to-electric signal converting element for generating a key position signal and a light-emitting element for radiating a light beam to said light-to-electric signal converting element.

8. The musical instrument as set forth in claim 7, further comprising key action mechanisms respectively connected to said keys, hammers respectively connected to said key action mechanisms and driven for rotation by said key action mechanisms when the associated keys are moved from said respective rest positions to said respective end positions, strings respectively struck with said hammers for generating acoustic sounds, and key actuators provided for said keys, respectively, and selectively energized with driving signals by said controller for moving the associated keys, said controller regulating one of said driving signals so as to give said attribute to the acoustic sound.

9. The keyboard musical instrument as set forth in claim 7, further comprising key action mechanisms respectively connected to said keys, hammers respectively connected to said key action mechanisms and driven for rotation by said key action mechanisms when the associated keys are moved from said respective rest positions to said respective end positions, strings respectively struck with said hammers for generating acoustic sounds, and a stopper changed between a block position and a free position, said stopper in said block position causing said hammers to rebound thereon before striking the associated strings, said stopper in said free position allowing said hammer to strike said associated strings.

10. A position sensing device comprising:

plural sensors respectively provided for plural manipulators and respectively creating monitored ranges where said plural manipulators are moved, a physical quantity in each of said monitored ranges being varied depending upon a current position of associated one of said manipulators, and a controller, said controller capable of:

storing a first relation between the amount of said physical quantity and the current positions of said manipulators, storing a second relation between a relative value of said amount of physical quantity and said current positions of said manipulators, and determining the current position of each manipulated manipulator on the basis of the amount of physical quantity supplied from associated one of said plural sensors, wherein said controller calculates said relative value on the basis of said amount of physical quantity supplied from said associated one of said plural sensors for determining said current position of said each manipulated manipulator.

11. The position sensing device as set forth in claim 10, wherein said first relation is variable over time, and said controller changes said second relation when said first relation is varied.

12. The position sensing device as set forth in claim 11, wherein a reference value of said amount of physical quantity is predetermined at a reference current position in said first relation, and said controller calculates said relative value by using an equation expressed as $SAR=Sa\times N/L_{R2}$, where SAR is said relative value, Sa is the amount of physical quantity, N is an integer, and $L_{R2}$ said reference value.

13. A light-emitting controller for plural light-emitting elements, comprising:

a current-controlling circuit connected between a first source of power voltage and a power distribution line connected in parallel to said plural light-emitting elements and responsive to a first control signal for varying a resistance between said first source of power voltage and said power distribution line;

a selector connected between said plural light-emitting elements and a second source of power voltage different in voltage level from said first source of power voltage, and responsive to a second control signal for sequentially connecting said plural light-emitting elements to said second source of power voltage; and a signal generator supplying said first control signal and said second control signal to said current-controlling circuit and said selector so as to change said resistance optimum to selected one of said plural light-emitting elements.

14. The light-emitting controller as set forth in claim 13, in which said plural light-emitting elements vary the intensity of light depending upon the amount of current flowing therethrough, and said signal generator determines said first control signal depending upon said intensity of light.

15. The light-emitting controller as set forth in claim 14, in which said signal generator supplies said first control signal representative of increase of said electric current to said current-controlling circuit when said intensity of light is decreased.

* * * * *